US009299310B2

(12) United States Patent
Hong et al.

(10) Patent No.: US 9,299,310 B2
(45) Date of Patent: Mar. 29, 2016

(54) LOAD DRIVING APPARATUS AND DRIVING METHOD THEREOF

(71) Applicant: Novatek Microelectronics Corp., Hsinchu (TW)

(72) Inventors: Kuo-Che Hong, Hsinchu (TW); Ji-Ting Chen, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 288 days.

(21) Appl. No.: 13/753,530

(22) Filed: Jan. 30, 2013

(65) Prior Publication Data

US 2014/0078129 A1 Mar. 20, 2014

(30) Foreign Application Priority Data

Sep. 18, 2012 (TW) ..... 101134176 A

(51) Int. Cl.
*G09G 5/00* (2006.01)
*G09G 3/36* (2006.01)

(52) U.S. Cl.
CPC ..... *G09G 5/00* (2013.01); *G09G 3/3688* (2013.01); *G09G 3/3614* (2013.01); *G09G 2310/0248* (2013.01); *G09G 2310/0297* (2013.01); *G09G 2330/023* (2013.01)

(58) Field of Classification Search
CPC . G09G 3/3677; G09G 3/3685; G09G 3/3688; G09G 2310/0267; G09G 2310/027; G09G 2310/0272; G09G 2310/0275; G09G 3/3614; G09G 2310/0248; G09G 2310/0297; G09G 2330/023; G09G 2330/021; G09G 2310/0291
See application file for complete search history.

(56) References Cited

U.S. PATENT DOCUMENTS 7,911,437 B1 * 3/2011 Bell ..... G09G 3/3685 345/100
2010/0149171 A1 * 6/2010 Huang ..... G09G 3/3688 345/214

(Continued)

FOREIGN PATENT DOCUMENTS

CN 101794561 8/2010
CN 102005190 4/2011

(Continued)

OTHER PUBLICATIONS

"Office Action of Taiwan Counterpart Application", issued on Jul. 9, 2014, p. 1-p. 9.

(Continued)

*Primary Examiner* — Grant Sitta
*Assistant Examiner* — Amen Bogale
(74) *Attorney, Agent, or Firm* — Jianq Chyun IP Office

(57) ABSTRACT

A load driving apparatus including a first driving unit, a second driving unit, and a circuit switch module is disclosed. The first and the second driving unit are respectively disposed at a first driving channel and a second driving channel and respectively output a first driving signal and a second driving signal for driving a first load and a second load during a channel output period. The circuit switch module is coupled between the first and the second driving channel and includes a plurality of signal transmitting paths. During a data loading period and a charge sharing period, the circuit switch module turns on all the signal transmitting paths, so that a charge sharing effect between the first load and the second load is achieved during the charge sharing period and accordingly the power consumption is reduced. Additionally, a load driving method of the load driving apparatus is disclosed.

9 Claims, 7 Drawing Sheets

(56) References Cited

U.S. PATENT DOCUMENTS

| | | | | |
|---|---|---|---|---|
| 2010/0164619 | A1* | 7/2010 | Kim | H03F 1/523 330/124 R |
| 2011/0164006 | A1 | 7/2011 | Son et al. | |
| 2011/0310080 | A1* | 12/2011 | Tonomura | G09G 3/3688 345/211 |
| 2012/0081338 | A1 | 4/2012 | Kim et al. | |
| 2012/0169783 | A1 | 7/2012 | Park | |
| 2012/0280961 | A1* | 11/2012 | Son | G09G 3/3685 345/211 |

FOREIGN PATENT DOCUMENTS

| | | |
|---|---|---|
| CN | 102298897 | 12/2011 |
| CN | 102456310 | 5/2012 |
| TW | 201025237 | 7/2010 |
| TW | 201207807 | 2/2012 |

OTHER PUBLICATIONS

"Office Action of China Counterpart Application", issued on Apr. 28, 2015, p. 1-p. 10.

* cited by examiner

LOAD DRIVING APPARATUS AND DRIVING METHOD THEREOF

CROSS-REFERENCE TO RELATED APPLICATION

This application claims the priority benefit of Taiwan application serial no. 101134176, filed on Sep. 18, 2012. The entirety of the above-mentioned patent application is hereby incorporated by reference herein and made a part of this specification.

BACKGROUND OF THE INVENTION

1. Field of the Invention

The invention generally relates to a load driving apparatus and a driving method thereof, and more particularly, to a load driving apparatus with a charge sharing mechanism and a driving method thereof.

2. Description of Related Art

The technique of displaying images with a pixel array has become very common, and which is usually adopted by today's display panel apparatuses. Generally, a pixel array is driven to display an image by sequentially selecting desired pixels from the pixel array in two array directions and by using a source driver and a gate driver and then inputting corresponding pixel data to these selected pixels. In other words, the driving mechanism adopted by the source driver and the gate driver plays a very important role in the performance of a display panel apparatus.

Taking the source driver in a liquid crystal display (LCD) panel as an example, the source driver drives the pixel array by outputting driving signals (converted from image data) to corresponding pixels respectively through different driving channels. However, in a LCD panel, the polarities of the driving signals received by the pixels have to be periodically inverted in order to avoid liquid crystal polarization. Thus, the voltage amplitudes of the driving signals cause the source driver to consume more power to drive the pixel array.

The charge sharing technique is to couple different driving channels with each other so that the voltage levels on these driving channels are regulated to a common voltage level before the driving signals are output, and accordingly the power consumed by the load driving apparatus for changing the driving voltages output by different driving channels when the driving signals are output is reduced. Thereby, how to effectively apply the charge sharing concept to a load driving apparatus has become a major subject in today's design of load driving apparatuses.

SUMMARY OF THE INVENTION

Accordingly, the invention is directed to a load driving apparatus and a driving method thereof, in which a charge sharing mechanism is adopted such that charges can be repeatedly used, and accordingly the power consumed by the load driving apparatus for load driving can be reduced.

The invention provides a load driving apparatus including a first driving unit, a second driving unit, and a circuit switch module. The first driving unit is disposed at a first driving channel. During a channel output period, the first driving unit outputs a first driving signal to drive one of a first load and a second load. The second driving unit is disposed at a second driving channel. During the channel output period, the second driving unit outputs a second driving signal to drive the other one of the first load and the second load. The circuit switch module is coupled between the first driving channel and the second driving channel and includes a plurality of signal transmitting paths. During a data loading period and a charge sharing period, the circuit switch module turns on all the signal transmitting paths to achieve a charge sharing effect between the first load and the second load during the charge sharing period.

According to an embodiment of the invention, during the channel output period, the first driving unit drives the first load through a first signal transmitting path of the circuit switch module, and the second driving unit drives the second load through a second signal transmitting path of the circuit switch module.

According to an embodiment of the invention, during the channel output period, the first driving unit drives the second load through a third signal transmitting path of the circuit switch module, and the second driving unit drives the first load through a fourth signal transmitting path of the circuit switch module.

According to an embodiment of the invention, the charge sharing period is between the data loading period and the channel output period.

According to an embodiment of the invention, the circuit switch module includes a first switch, a second switch, a third switch, and a fourth switch. The first switch is disposed on the first signal transmitting path. A first terminal of the first switch is coupled to the first driving unit, and a second terminal of the first switch is coupled to the first load. The second switch is disposed on the second signal transmitting path. A first terminal of the second switch is coupled to the second driving unit, and a second terminal of the second switch is coupled to the second load. The third switch is disposed on the third signal transmitting path. A first terminal of the third switch is coupled to the first driving unit, and a second terminal of the third switch is coupled to the second load. The fourth switch is disposed on the fourth signal transmitting path. A first terminal of the fourth switch is coupled to the second driving unit, and a second terminal of the fourth switch is coupled to the first load. During the data loading period and the charge sharing period, the first switch, the second switch, the third switch, and the fourth switch are all turned on.

According to an embodiment of the invention, during the channel output period, the first switch and the second switch are turned on, and the third switch and the fourth switch are turned off. During a next channel output period after aforementioned channel output period, the third switch and the fourth switch are turned on, and the first switch and the second switch are turned off.

According to an embodiment of the invention, the first driving channel and the second driving channel respectively include a fifth switch. The fifth switch has a first terminal and a second terminal. The first terminal of the fifth switch of the first driving channel is coupled to the first terminals of the first switch and the third switch, and the second terminal of the fifth switch of the first driving channel is coupled to the first driving unit. The first terminal of the fifth switch of the second driving channel is coupled to the first terminals of the second switch and the fourth switch, and the second terminal of the fifth switch of the second driving channel is coupled to the second driving unit. During the data loading period and the charge sharing period, the fifth switches are turned off, and during the channel output period, the fifth switches are turned on.

According to an embodiment of the invention, the circuit switch module further includes a sixth switch. A first terminal of the sixth switch is coupled to the first terminals of the first switch and the third switch, and a second terminal of the sixth switch is coupled to the first terminals of the second switch and the fourth switch. During the data loading period and the charge sharing period, the sixth switch is turned on, and during the channel output period, the sixth switch is turned off.

According to an embodiment of the invention, the circuit switch module further includes a seventh switch. A first terminal of the seventh switch is coupled to the second terminals of the first switch and the fourth switch, and a second terminal of the seventh switch is coupled to the second terminals of the second switch and the third switch. During the data loading period and the charge sharing period, the seventh switch is turned on, and during the channel output period, the seventh switch is turned off.

According to an embodiment of the invention, the first driving channel and the second driving channel respectively include an eighth switch. The eighth switch has a first terminal and a second terminal. The first terminal of the eighth switch of the first driving channel is coupled to the first terminals of the first switch and the third switch, and the second terminal of the eighth switch of the first driving channel is coupled to a voltage source. The first terminal of the eighth switch of the second driving channel is coupled to the first terminals of the second switch and the fourth switch, and the second terminal of the eighth switch of the second driving channel is coupled to the voltage source. During the data loading period and the charge sharing period, the eighth switch is turned on, and during the channel output period, the eighth switch is turned off.

According to an embodiment of the invention, the first driving channel and the second driving channel respectively include a ninth switch. The ninth switch has a first terminal and a second terminal. The first terminal of the ninth switch of the first driving channel is coupled to the second terminals of the first switch and the fourth switch, and the second terminal of the ninth switch of the first driving channel is coupled to a voltage source. The first terminal of the ninth switch of the second driving channel is coupled to the second terminals of the second switch and the third switch, and the second terminal of the ninth switch of the second driving channel is coupled to the voltage source. During the data loading period and the charge sharing period, the ninth switches are turned on, and during the channel output period, the ninth switches are turned off.

The invention provides a load driving method adapted to a load driving apparatus. The load driving apparatus includes a circuit switch module, and the circuit switch module includes a plurality of signal transmitting paths. The load driving method includes following steps. During a data loading period, all the signal transmitting paths are turned on. During a charge sharing period, all the signal transmitting paths are turned on to achieve a charge sharing effect between a first load and a second load. During a channel output period, a first driving signal is output to drive one of the first load and the second load, and a second driving signal is output to drive the other one of the first load and the second load.

According to an embodiment of the invention, the step of driving the first load and the second load during the channel output period includes outputting the first driving signal to drive the first load through a first signal transmitting path of the circuit switch module and outputting the second driving signal to drive the second load through a second signal transmitting path of the circuit switch module.

According to an embodiment of the invention, the step of driving the first load and the second load during the channel output period includes outputting the first driving signal to drive the second load through a third signal transmitting path of the circuit switch module and outputting the second driving signal to drive the first load through a fourth signal transmitting path of the circuit switch module.

According to an embodiment of the invention, the charge sharing period is between the data loading period and the channel output period.

According to an embodiment of the invention, the load driving method further includes supplying a specific voltage level to the circuit switch module during the charge sharing period to achieve a charge sharing effect between the first load and the second load.

As described above, in a load driving apparatus and a driving method thereof provided by embodiments of the invention, a charge sharing effect is achieved among the driven loads during a charge sharing period by turning on a plurality of switches in a circuit switch module, so that the power consumed by the load driving apparatus for loading driving is reduced.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
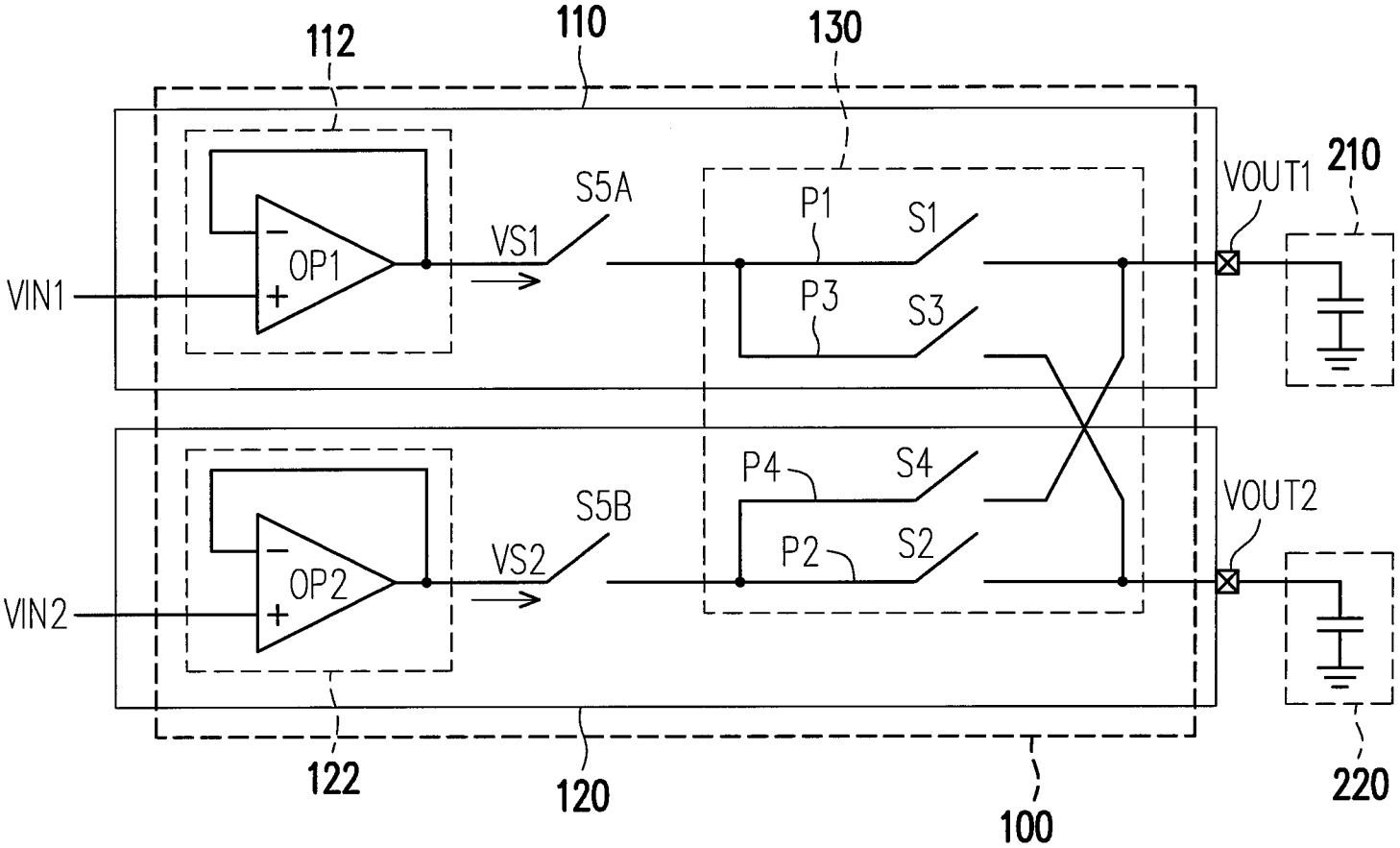
FIG. 1 is a circuit diagram of a load driving apparatus according to an exemplary embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

In an exemplary embodiment of the invention, a circuit switch module achieves a charge sharing effect among high voltage level driving channels and low voltage level driving channels of a load driving apparatus through transistor switches. In another exemplary embodiment, the voltage levels of the high voltage level driving channels and the low voltage level driving channels can be regulated after charge sharing. Below, exemplary embodiments of the invention will be described in detail with reference to accompanying drawings.

FIG. 1 is a circuit diagram of a load driving apparatus according to an exemplary embodiment of the invention. Referring to FIG. 1, the load driving apparatus 100 in the present embodiment includes a first driving unit 112, a second driving unit 122, and a circuit switch module 130. The first driving unit 112 is disposed at a first driving channel 110. The first driving unit 112 receives an image data VIN1 and outputs a first driving signal VS1 to drive one of a first load 210 and a second load 220 during a channel output period according to the image data VIN1. The second driving unit 122 is disposed at a second driving channel 120. The second driving unit 122 receives an image data VIN2 and outputs a second driving signal VS2 to drive the other one of the first load 210 and the second load 220 during the channel output period according to the image data VIN2. Namely, during the channel output period, when the first driving unit 112 drives the first load 210, the second driving unit 122 drives the second load 220, and contrarily, when the first driving unit 112 drives the second load 220, the second driving unit 122 drives the first load 210.

In the present embodiment, the first driving unit 112 and the second driving unit 122 respectively include an operational amplifier OP1 and an operational amplifier OP2 and respectively have a first input terminal, a second input terminal, and an output terminal. The first input terminals of the first driving unit 112 and the second driving unit 122 are both non-inverting input terminals and are respectively configured to receive the image data VIN1 and VIN2. The output terminal of the first driving unit 112 is coupled to the circuit switch module 130 and the second input terminal thereof and outputs the first driving signal VS1 according to the received image data VIN1. The output terminal of the second driving unit 122 is coupled to the circuit switch module 130 and the second input terminal thereof and outputs the second driving signal VS2 according to the received image data VIN2.

In the present embodiment, the first load 210 and the second load 220 may be one or more electronic devices or any type of load circuits. When the load driving apparatus 100 is served as the driving apparatus of a source driver, the first load 210 and the second load 220 are a plurality of pixels to be driven on a display panel. In FIG. 1, the first load 210 and the second load 220 are respectively illustrated as a grounded equivalent capacitor.

Additionally, the circuit switch module 130 in the present embodiment is coupled between the first driving channel 110 and the second driving channel 120 and includes a plurality of signal transmitting paths P1-P4. During a data loading period and a charge sharing period, the signal transmitting paths P1-P4 of the circuit switch module 130 are all turned on, so that a charge sharing effect is achieved between the first load 210 and the second load 220 during the charge sharing period.

During a channel input period, the signal transmitting paths P1-P4 of the circuit switch module 130 are alternatively turned on, so that the first driving signal VS1 and the second driving signal VS2 alternatively drive the first load 210 and the second load 220. In the present embodiment, during a channel input period, when the first driving signal VS1 output by the first driving unit 112 drives the first load 210 through the first signal transmitting path P1, the second driving signal VS2 output by the second driving unit 122 drives the second load 220 through the second signal transmitting path P2. During a next channel input period, when the first driving signal VS1 drives the second load 220 through the third signal transmitting path P3, the second driving signal VS2 drives the first load 210 through the fourth signal transmitting path P4, so that an alternative loading driving purpose is achieved. However, during the data loading period and the charge sharing period, the signal transmitting paths P1-P4 of the circuit switch module 130 are all turned on to achieve a charge sharing effect.

In order to accomplish the operations described above, in the present embodiment, the circuit switch module 130 includes a first switch S1, a second switch S2, a third switch S3, and a fourth switch S4. The first switch S1 is disposed on the first signal transmitting path P1. The first terminal of the first switch S1 is coupled to the first driving unit 112, and the second terminal of the first switch S1 is coupled to the first load 210. The second switch S2 is disposed on the second signal transmitting path P2. The first terminal of the second switch S2 is coupled to the second driving unit 122, and the second terminal of the second switch S2 is coupled to the second load 220. The third switch S3 is disposed on the third signal transmitting path P3. The first terminal of the third switch S3 is coupled to the first driving unit 112, and the second terminal of the third switch S3 is coupled to the second load 220. The fourth switch S4 is disposed on the fourth signal transmitting path P4. The first terminal of the fourth switch S4 is coupled to the second driving unit 122, and the second terminal of the fourth switch S4 is coupled to the first load 210. The switches mentioned above may be transistor switches or other electronic devices that can be used as switches. However, the type of the switches is not limited in the invention.

In the present embodiment, during a channel input period, the first switch S1 and the second switch S2 are both turned on so that the first driving unit 112 and the second driving unit 122 respectively drive the first load 210 and the second load 220 through the first signal transmitting path P1 and the second signal transmitting path P2. As time progress, during the next channel input period, the third switch S3 and the fourth switch S4 are both turned on so that the first driving unit 112 and the second driving unit 122 respectively drive the second load 220 and the first load 210 through the third signal transmitting path P3 and the fourth signal transmitting path P4.

In the present embodiment, during the data loading period and the charge sharing period, the first switch S1, the second switch S2, the third switch S3, and the fourth switch S4 are all turned on. Accordingly, the signal transmitting paths P1-P4 of the circuit switch module 130 are all turned on, so that a charge sharing effect is achieved between the first load 210 and the second load 220 during the charge sharing period.

Referring to FIG. 1 again, in the present embodiment, the first driving channel 110 and the second driving channel 120 of the load driving apparatus 100 further include fifth switches S5A and S5B respectively. The first terminal of the fifth switch S5A of the first driving channel 110 is coupled to the first terminals of the first switch S1 and the third switch S3, and the second terminal of the fifth switch S5A of the first driving channel 110 is coupled to the first driving unit 112. The first terminal of the fifth switch S5B of the second driving channel 120 is coupled to the first terminals of the second switch S2 and the fourth switch S4, and the second terminal of the fifth switch S5B of the second driving channel 120 is coupled to the second driving unit 122. During the data loading period and the charge sharing period, the fifth switches S5A and S5B are turned off to prevent the driving side and the load side from interfering each other during these two periods. On the other hand, during the channel output period, the fifth switches S5A and S5B are turned on so that the first driving signal VS1 and the second driving signal VS2 output by the first driving unit 112 and the second driving unit 122 can be transmitted to the first load 210 and the second load 220.

To put it simply, in the present embodiment, the first driving channel 110 is served as a high voltage level driving channel, and the second driving channel 120 is served as a low voltage level driving channel. When the load driving apparatus 100 loads data, the fifth switches S5A and S5B are turned off, and the switches S1-S4 are all turned on, so that different driving channels are connected with each other. Moreover, charges in the high voltage level driving channel are provided to the low voltage level driving channel to achieve a charge sharing effect. When a driving channel is about to output a voltage to drive a load, one of the switch set S1 and S2 and the switch set S3 and S4 is turned on to output the target voltage and drive the load. Through such a control mechanism, a charge sharing effect, and accordingly a power saving effect, can be achieved.

Figure 2:
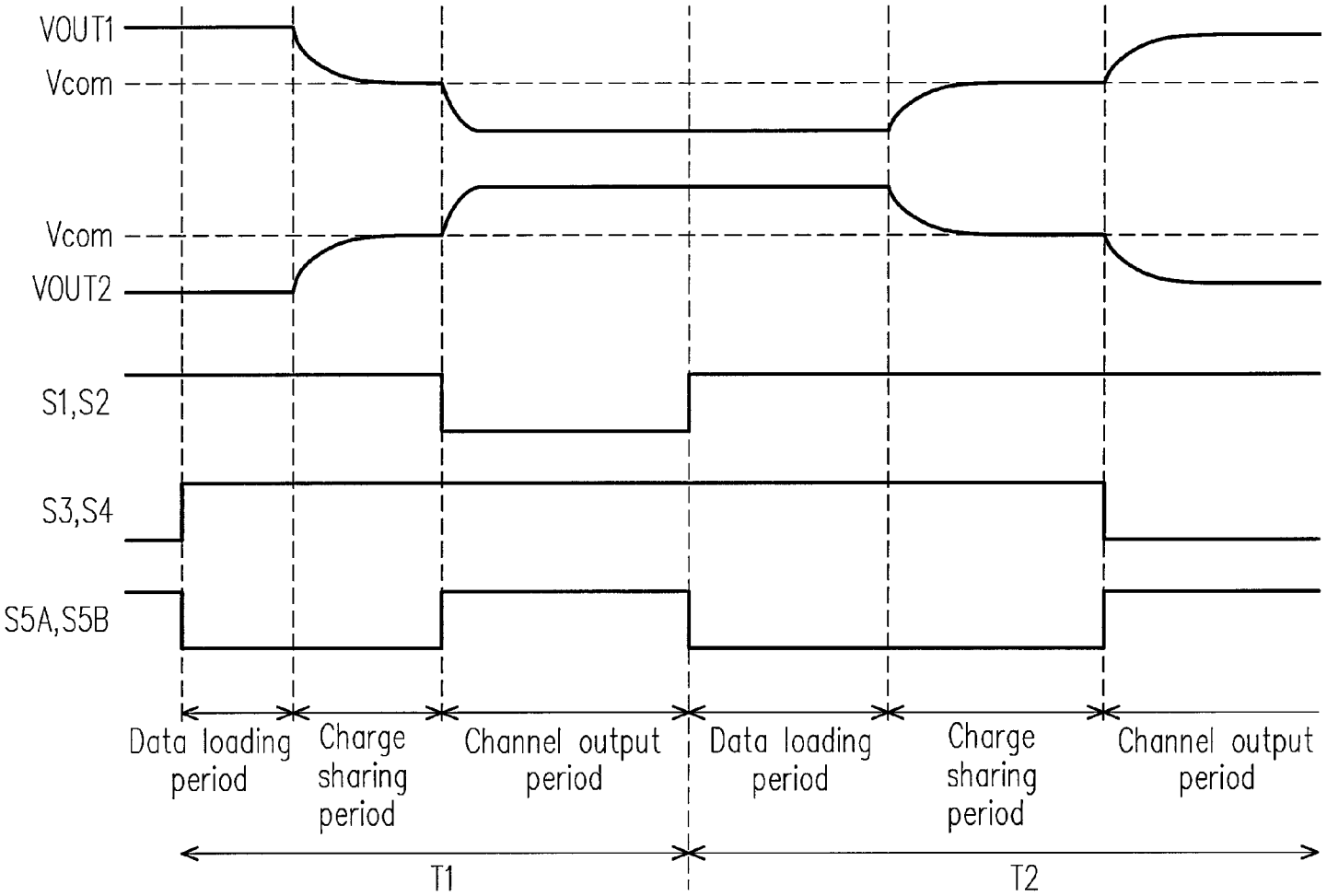
FIG. 2 is a timing diagram of signals in the load driving apparatus in FIG. 1.

FIG. 2 is a timing diagram of signals in the load driving apparatus in FIG. 1. Referring to FIG. 1 and FIG. 2, during the cycles T1 and T2, the load driving apparatus 100 drives the first load 210 and the second load 220. The cycles T1 and T2 in the present embodiment include a data loading period, a charge sharing period, and a channel output period. The charge sharing period is between the data loading period and the channel output period, and the three periods are consecutive. In the present embodiment, the first driving channel 110 is connected with the first load 210 through an output pad VOUT1, and the second driving channel 120 is connected with the second load 220 through an output pad VOUT2. The voltage waveforms of the output pads VOUT1 and VOUT2 are illustrated in FIG. 2 and respectively represent the variations of the voltage levels on the first load 210 and the second load 220. During the data loading period and the charge sharing period of the cycle T1, the switches S1, S2, S3, and S4 of the circuit switch module 130 are all turned on, and the fifth switches S5A and S5B are turned off. Because the switches S1, S2, S3, and S4 are turned on, as shown in FIG. 2, during the charge sharing period, the voltage levels on the output pads VOUT1 and VOUT2 are adjusted to be substantially the same (for example, a common voltage Vcom). Before the cycle T1, the voltage level on the output pad VOUT1 is higher than that on the output pad VOUT2. Thus, during the charge sharing period, the voltage level on the output pad VOUT1 is decreased, while the voltage level on the output pad VOUT2 is increased.

During the channel output period of the cycle T1, the fifth switches S5A and S5B and the switches S3 and S4 of the circuit switch module 130 are turned on, but the switches S1 and S2 are turned off. The first driving signal VS1 is transmitted to the second load 220 through the third signal transmitting path P3, and the second driving signal VS2 is transmitted to the first load 210 through the fourth signal transmitting path P4. Because the voltage levels on the first load 210 and the second load 220 are regulated during the charge sharing period through the charge sharing effect, during the channel output period, the power consumed for changing the voltage levels on the first load 210 and the second load 220 is less than that consumed without the charge sharing effect. Accordingly, the power saving effect is achieved.

Similarly, during the data loading period and the charge sharing period of the cycle T2, the switches S1-S4 of the circuit switch module 130 are all turned on, while the fifth switches S5A and S5B are turned off. During the charge sharing period, the voltage levels on the output pads VOUT1 and VOUT2 are adjusted to the common voltage Vcom again. It should be noted that during the channel output period of the cycle T2, the fifth switches S5A and S5B and the switches S1 and S2 of the circuit switch module 130 are turned on, while the switches S3 and S4 are turned off. Herein the first driving signal VS1 is transmitted to the first load 210 through the first signal transmitting path P1, and the second driving signal VS2 is transmitted to the second load 220 through the second signal transmitting path P2.

Figure 3:
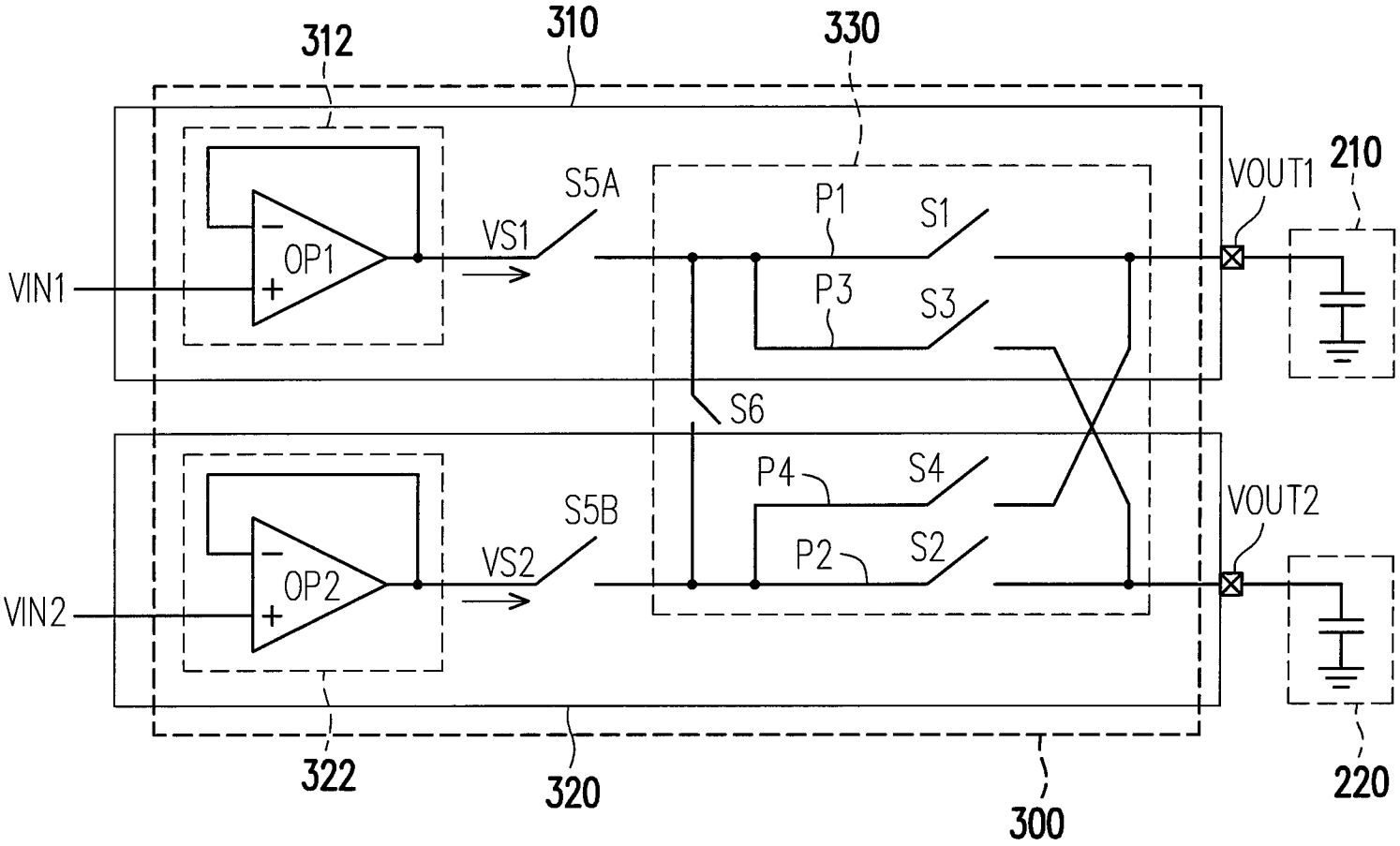
FIG. 3 is a circuit diagram of a load driving apparatus according to another exemplary embodiment of the invention.

In an embodiment of the invention, the circuit switch module further includes one or more switch elements in order to achieve an enhanced charge sharing effect. FIG. 3 is a circuit diagram of a load driving apparatus according to another exemplary embodiment of the invention. Referring to FIG. 3, the load driving apparatus 300 in the present embodiment is similar to the load driving apparatus 100 illustrated in FIG. 1, and the major difference between the two load driving apparatuses is that the circuit switch module 330 of the load driving apparatus 300 further includes a sixth switch S6. The first terminal of the sixth switch S6 is coupled to the first terminals of the first switch S1 and the third switch S3, and the second terminal of the sixth switch S6 is coupled to the first terminals of the second switch S2 and the fourth switch S4. During the charge sharing period, the sixth switch S6 increases the speed of regulating the voltage levels on the first load 210 and the second load 220 to the common voltage level. Namely, the charge sharing period of the load driving apparatus 300 is shorter than that of the load driving apparatus 100 as shown in FIG. 2.

Figure 4:
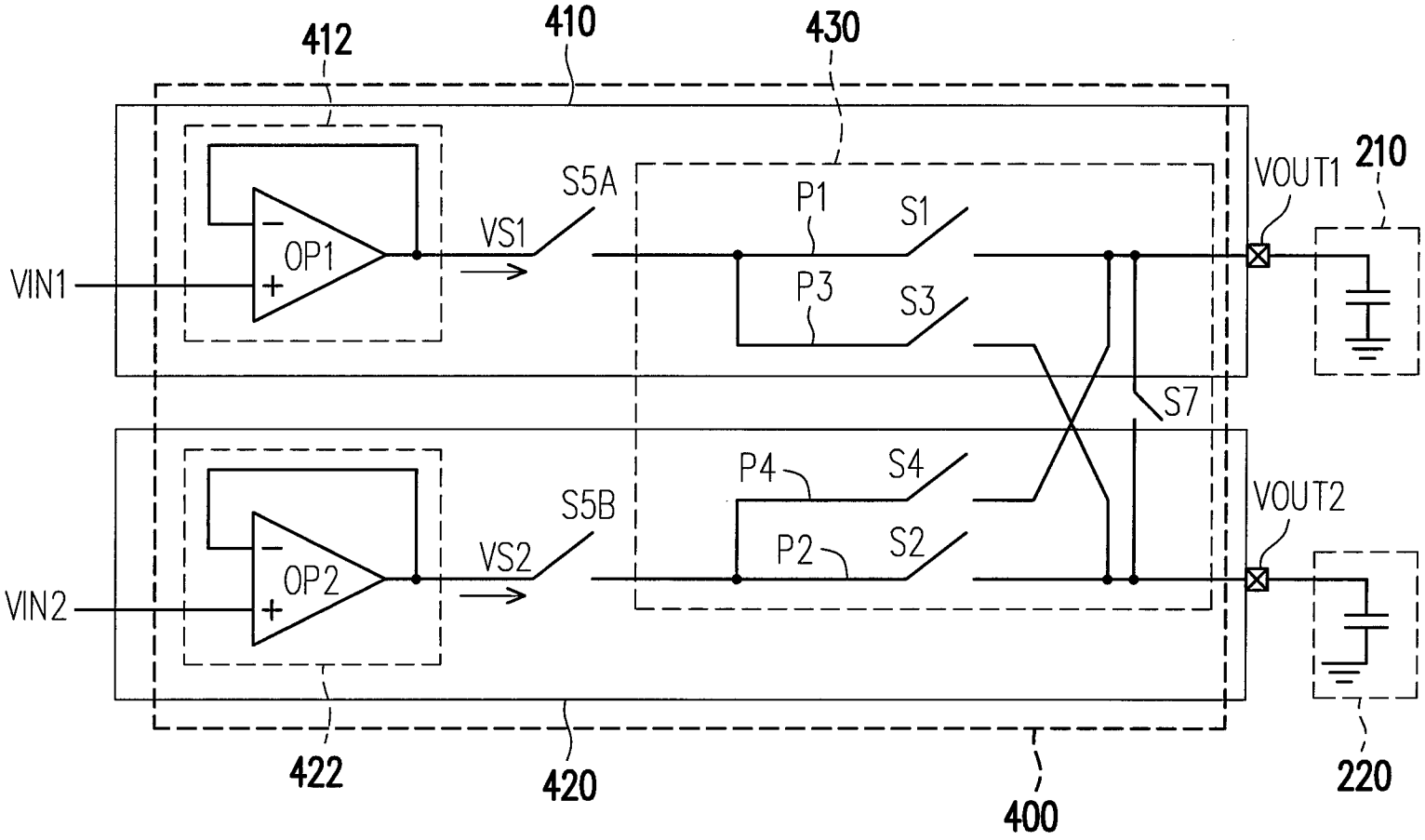
FIG. 4 is a circuit diagram of a load driving apparatus according to another exemplary embodiment of the invention.

FIG. 4 is a circuit diagram of a load driving apparatus according to another exemplary embodiment of the invention. Referring to FIG. 4, the load driving apparatus 400 in the present embodiment is similar to the load driving apparatus 300 illustrated in FIG. 3, and the major difference between the two load driving apparatuses falls on the disposition of a seventh switch S7 in the load driving apparatus 400. The circuit switch module 430 includes a seventh switch S7. The first terminal of the seventh switch S7 is coupled to the second terminals of the first switch S1 and the fourth switch S4, and the second terminal of the seventh switch S7 is coupled to the second terminals of the second switch S2 and the third switch S3. Similarly, during the charge sharing period, the seventh switch S7 increases the speed of regulating the voltage levels on the first load 210 and the second load 220 to the common voltage level. Namely, the charge sharing period of the load driving apparatus 400 is shorter than that of the load driving apparatus 100 as shown in FIG. 2.

According to the embodiments illustrated in FIG. 3 and FIG. 4, the sixth switch S6 and the seventh switch S7 are turned on during the data loading period and the charge sharing period to facilitate the charge sharing effect in the circuit switch module and improve the efficiency thereof. During the channel output period, the sixth switch S6 and the seventh switch S7 are turned off so that the first driving signal VS1 and the second driving signal VS2 are prevented from interfering each other.

According to an embodiment of the invention, during a data loading period and a charge sharing period, a plurality of signal transmitting paths is turned on to achieve a charge sharing effect between a first load and a second load, and the voltage levels on the first load and the second load are regulated to the same voltage level. However, according to other exemplary embodiments of the invention, during the charge sharing period, an external voltage source may be supplied to the driving channels to regulate the voltage levels to a specific voltage level.

Figure 5:
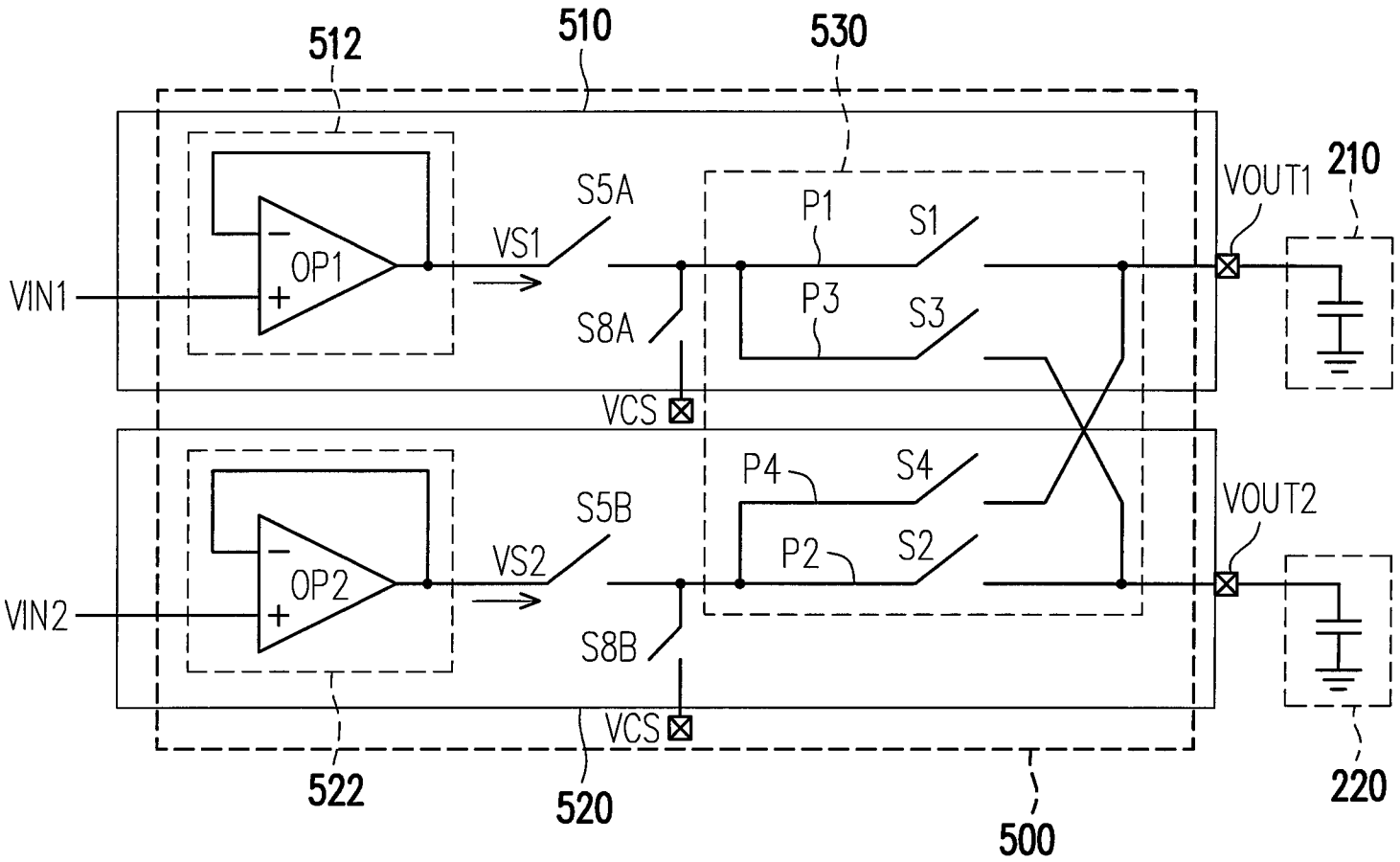
FIG. 5 is a circuit diagram of a load driving apparatus according to another exemplary embodiment of the invention.
Figure 6:
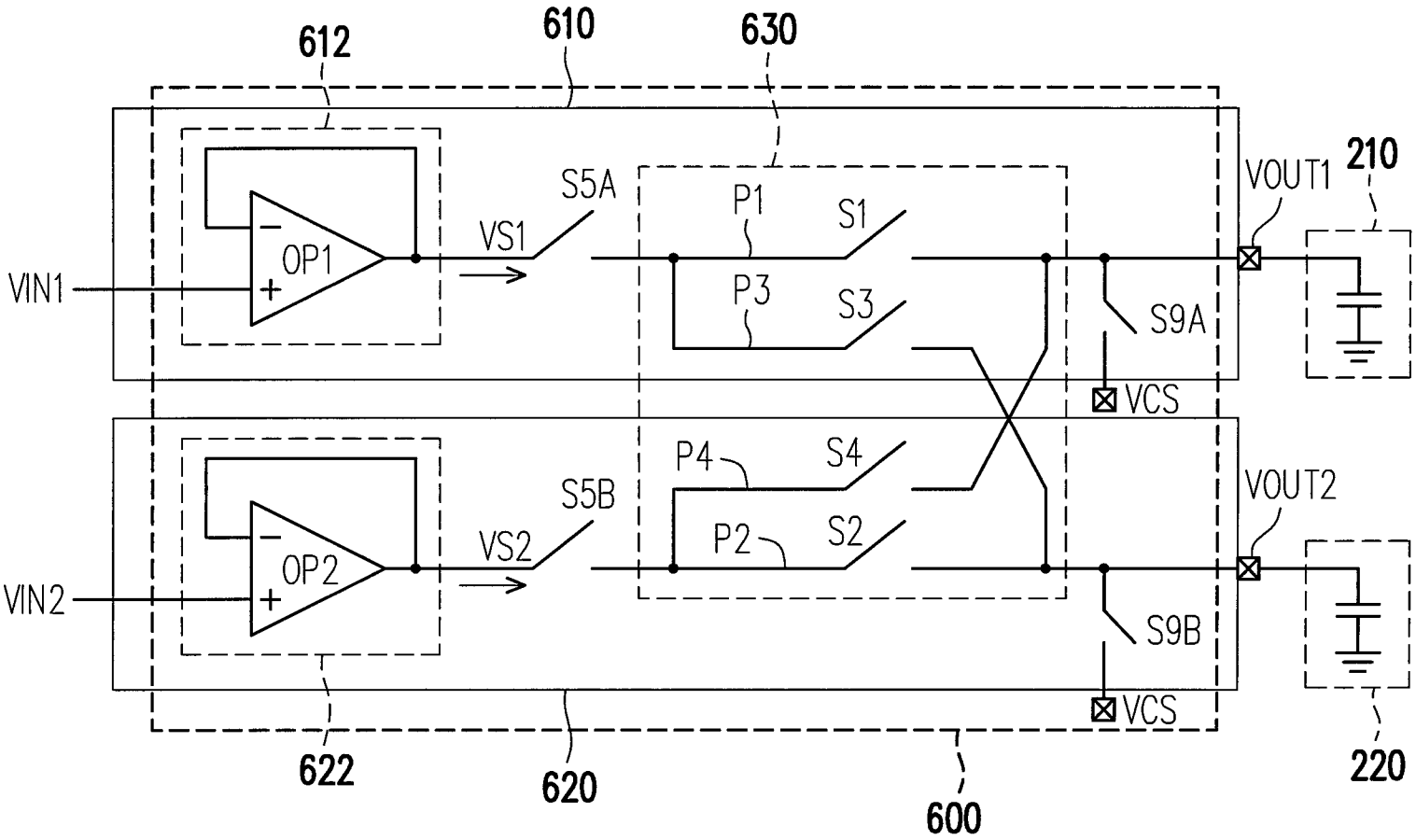
FIG. 6 is a circuit diagram of a load driving apparatus according to another exemplary embodiment of the invention.

FIG. 5 and FIG. 6 are circuit diagrams of load driving apparatuses according to different exemplary embodiments of the invention. Referring to FIG. 5, the first driving channel 510 and the second driving channel 520 of the load driving apparatus 500 respectively include eighth switches S8A and S8B. The first terminal of the eighth switch S8A of the first driving channel 510 is coupled to the first terminals of the first switch S1 and the third switch S3, and the second terminal of the eighth switch S8A of the first driving channel 510 is coupled to a voltage source VCS. The first terminal of the eighth switch S8B of the second driving channel 520 is coupled to the first terminals of the second switch S2 and the fourth switch S4, and the second terminal of the eighth switch S8B of the second driving channel 520 is coupled to the voltage source VCS. During the data loading period and the charge sharing period, the eighth switches S8A and S8B are turned on, so that the voltage levels of the first load 210 and the second load 220 can be regulated to a specific voltage level by the voltage source VCS during the charge sharing period. During the channel output period, the eighth switches S8A and S8B are turned off, so that the first driving signal VS1 and the second driving signal VS2 are not affected by the voltage source VCS.

By disposing the eighth switches S8A and S8B and respectively coupling the first driving channel 510 and the second driving channel 520 to the voltage source VCS, the load driving apparatus 500 can regulate the voltage levels of the driving channels to a specific voltage level during the charge sharing period according to the design requirement of different application. Additionally, in the present embodiment, during the data loading period and the charge sharing period, the eighth switches S8A and S8B can be selectively turned off to achieve the charge sharing effect between the first driving channel 510 and the second driving channel 520 only through the circuit switch module 530, and the application of the load driving apparatus 500 is not limited herein.

FIG. 6 is a circuit diagram of a load driving apparatus according to another exemplary embodiment of the invention. Referring to FIG. 6, the load driving apparatus 600 in the present embodiment is similar to the load driving apparatus 500 illustrated in FIG. 5, and the major difference between the two load driving apparatuses falls on the disposition of two ninth switches S9A and S9B in the load driving apparatus 600. Similarly, the ninth switches S9A and S9B of the load driving apparatus 600 have the same function as the eighth switches S8A and S8B of the load driving apparatus 500. During the data loading period and the charge sharing period, the ninth switches S9A and S9B are turned on so that the voltage levels of the first load 210 and the second load 220 are regulated to a specific voltage level during the charge sharing period by the voltage source VCS. During the channel output period, the ninth switches S9A and S9B are turned off so that the first driving signal VS1 and the second driving signal VS2 are not affected by the voltage source VCS.

In the present embodiment, the first driving channel 610 and the second driving channel 620 of the load driving apparatus 600 respectively include the ninth switches S9A and S9B. The first terminal of the ninth switch S9A of the first driving channel 610 is coupled to the second terminals of the first switch S1 and the fourth switch S4, and the second terminal of the ninth switch S9A of the first driving channel 610 is coupled to the voltage source VCS. The first terminal of the ninth switch S9B of the second driving channel 620 is coupled to the second terminals of the second switch S2 and the third switch S3, and the second terminal of the ninth switch S9B of the second driving channel 620 is coupled to the voltage source VCS. It should be mentioned that unlike the eighth switches S8A and S8B, the ninth switches S9A and S9B in the present embodiment are respectively and directly coupled to the output pads VOUT1 and VOUT2 without going through the switches S1-S4. Thus, during the charge sharing period, the first load 210 and the second load 220 in the present embodiment can reach the desired specific voltage level in a shorter time.

Figure 7:
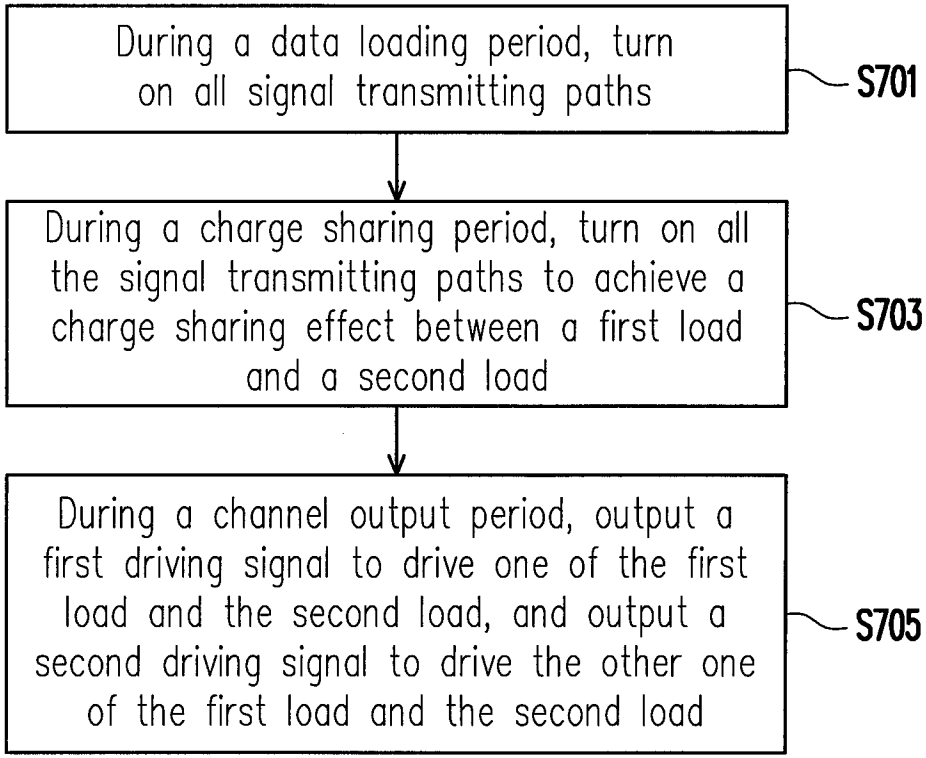
FIG. 7 is a flowchart of a load driving method according to an exemplary embodiment of the invention.

FIG. 7 is a flowchart of a load driving method according to an exemplary embodiment of the invention. Referring to FIG. 1, FIG. 2, and FIG. 7, the load driving method in the present embodiment is adapted to at least the load driving apparatuses illustrated in FIGS. 1-6 and includes following steps. First, in step S701, during a data loading period, all signal transmitting paths P1-P4 are turned on. In the present embodiment, the circuit switch module 130 has a plurality of signal transmitting paths P1-P4, and the signal transmitting paths P1-P4 are all turned on during the data loading period. Then, in step S703, during a charge sharing period, all the signal transmitting paths P1-P4 are turned on to achieve a charge sharing effect between the first load 210 and the second load 220, so that the voltage levels on the first load 210 and the second load 220 can be regulated to be substantially the same voltage level through the charge sharing effect. However, the invention is not limited thereto, and in other embodiments, the step S703 may further include supplying a specific voltage level to the circuit switch module to achieve the charge sharing effect between the first load 210 and the second load 220.

In the present embodiment, in step S705 after step S703, during a channel output period, a first driving signal VS1 is output to drive one of the first load 210 and the second load 220, and a second driving signal VS2 is output to drive the other one of the first load 210 and the second load 220. Within the channel output periods, the signal transmitting paths P1-P4 of the circuit switch module 130 are alternatively turned on, so that the first driving signal VS1 and the second driving signal VS2 can alternatively drive the first load 210 and the second load 220. In an embodiment of the invention, during a channel output period, the first driving signal VS1 is output to drive the first load 210 through the first signal transmitting path P1 of the circuit switch module 130, and the second driving signal VS2 is output to drive the second load 220 through the second signal transmitting path P2 of the circuit switch module 130. During the next channel output period, the first driving signal VS1 is output to drive the second load 220 through the third signal transmitting path P3 of the circuit switch module 130, and the second driving signal VS2 is output to drive the first load 210 through the fourth signal transmitting path P4 of the circuit switch module 130.

According to the present embodiment, the charge sharing period is between the data loading period and the channel output period, and the three periods are consecutive, as shown in FIG. 2. Meanwhile, the load driving method can start to execute the step S701 once again after the step S705. The load driving method in the present embodiment can be well understood and implemented by referring to descriptions related to the embodiments illustrated in FIGS. 1-6 therefore will not be described in detail herein.

As described above, according to an exemplary embodiment of the invention, a load driving apparatus has a circuit switch module, and the circuit switch module has a plurality of signal transmitting paths. During a charge sharing period, the signal transmitting paths are all turned on to achieve a charge sharing effect, and during a channel output period, the signal transmitting paths are turned on so that the load driving apparatus can respectively drive multiple loads. Through repeated use of charges, the power consumption of the load driving apparatus is reduced and the power saving purpose is accomplished.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A load driving apparatus, comprising:

a first driving unit, disposed at a first driving channel, wherein during a channel output period, the first driving unit outputs a first driving signal to drive one of a first load and a second load;

a second driving unit, disposed at a second driving channel, wherein during the channel output period, the second driving unit outputs a second driving signal to drive another one of the first load and the second load; and a circuit switch module, coupled between the first driving channel and the second driving channel, and comprising a plurality of signal transmitting paths, wherein during a data loading period and a charge sharing period, the circuit switch module turns on all the signal transmitting paths to achieve a charge sharing effect between the first load and the second load during the charge sharing period, wherein the circuit switch module comprises:

a first switch, disposed at a first signal transmitting path, wherein a first terminal of the first switch is coupled to the first driving unit, and a second terminal of the first switch is coupled to the first load;

a second switch, disposed at a second signal transmitting path, wherein a first terminal of the second switch is coupled to the second driving unit, and a second terminal of the second switch is coupled to the second load;

a third switch, disposed at a third signal transmitting path, wherein a first terminal of the third switch is coupled to the first driving unit, and a second terminal of the third switch is coupled to the second load;

a fourth switch, disposed at a fourth signal transmitting path, wherein a first terminal of the fourth switch is coupled to the second driving unit, and a second terminal of the fourth switch is coupled to the first load; and a fifth switch, having a first terminal and a second terminal, wherein the first terminal of the fifth switch of the first driving channel is coupled to the first terminals of the first switch and the third switch, the second terminal of the fifth switch of the first driving channel is coupled to the first driving unit, the first terminal of the fifth switch of the second driving channel is coupled to the first terminals of the second switch and the fourth switch, and the second terminal of the fifth switch of the second driving channel is coupled to the second driving unit, wherein during the data loading period and the charge sharing period, the first switch, the second switch, the third switch, and the fourth switch are all turned on, wherein during the data loading period and the charge sharing period, the fifth switches are turned off, such that the first driving unit and the second driving unit are disconnected from the circuit switch module, and during the channel output period, the fifth switches are turned on.

2. The load driving apparatus according to claim 1, wherein during the channel output period, the first driving unit drives the first load through the first signal transmitting path of the circuit switch module, and the second driving unit drives the second load through the second signal transmitting path of the circuit switch module.

3. The load driving apparatus according to claim 1, wherein during the channel output period, the first driving unit drives the second load through the third signal transmitting path of the circuit switch module, and the second driving unit drives the first load through the fourth signal transmitting path of the circuit switch module.

4. The load driving apparatus according to claim 1, wherein the charge sharing period is between the data loading period and the channel output period.

5. The load driving apparatus according to claim 1, wherein during the channel output period, the first switch and the second switch are turned on, and the third switch and the fourth switch are turned off, and during a next channel output period after the channel output period, the third switch and the fourth switch are turned on, and the first switch and the second switch are turned off.

6. The load driving apparatus according to claim 1, wherein the circuit switch module further comprises:

a sixth switch, wherein a first terminal of the sixth switch is coupled to the first terminals of the first switch and the third switch, and a second terminal of the sixth switch is coupled to the first terminals of the second switch and the fourth switch, wherein during the data loading period and the charge sharing period, the sixth switch is turned on, and during the channel output period, the sixth switch is turned off.

7. The load driving apparatus according to claim 1, wherein the circuit switch module further comprises:

a seventh switch, wherein a first terminal of the seventh switch is coupled to the second terminals of the first switch and the fourth switch, and a second terminal of the seventh switch is coupled to the second terminals of the second switch and the third switch, wherein during the data loading period and the charge sharing period, the seventh switch is turned on, and during the channel output period, the seventh switch is turned off.

8. The load driving apparatus according to claim 1, wherein the first driving channel and the second driving channel respectively comprise:

an eighth switch, having a first terminal and a second terminal, wherein the first terminal of the eighth switch of the first driving channel is coupled to the first terminals of the first switch and the third switch, the second terminal of the eighth switch of the first driving channel is coupled to a voltage source, the first terminal of the eighth switch of the second driving channel is coupled to the first terminals of the second switch and the fourth switch, and the second terminal of the eighth switch of the second driving channel is coupled to the voltage source, wherein during the data loading period and the charge sharing period, the eighth switches are turned on, and during the channel output period, the eighth switches are turned off.

9. The load driving apparatus according to claim 1, wherein the first driving channel and the second driving channel respectively comprise:

a ninth switch, having a first terminal and a second terminal, wherein the first terminal of the ninth switch of the first driving channel is coupled to the second terminals of the first switch and the fourth switch, the second terminal of the ninth switch of the first driving channel is coupled to a voltage source, the first terminal of the ninth switch of the second driving channel is coupled to the second terminals of the second switch and the third switch, and the second terminal of the ninth switch of the second driving channel is coupled to the voltage source, wherein during the data loading period and the charge sharing period, the ninth switches are turned on, and during the channel output period, the ninth switches are turned off.

* * * * *